US011108125B2

(12) United States Patent
Xiong et al.

(10) Patent No.: US 11,108,125 B2
(45) Date of Patent: Aug. 31, 2021

(54) HIGH-EFFICIENCY INTEGRATED CIRCULATOR/ISOLATOR

(71) Applicant: Shenzhen Huayang Technology Development Co., Ltd., Shenzhen (CN)

(72) Inventors: Fei Xiong, Shenzhen (CN); Wei Zhang, Shenzhen (CN)

(73) Assignee: Shenzhen Huayang Technology Development Co., Ltd., Shenzhen (CN)

( * ) Notice: Subject to any disclaimer, the term of this patent is extended or adjusted under 35 U.S.C. 154(b) by 68 days.

(21) Appl. No.: 16/619,205

(22) PCT Filed: Aug. 30, 2018

(86) PCT No.: PCT/CN2018/103301

§ 371 (c)(1),
(2) Date: Dec. 4, 2019

(87) PCT Pub. No.: WO2020/042093

PCT Pub. Date: Mar. 5, 2020

(65) Prior Publication Data

US 2021/0091446 A1 Mar. 25, 2021

(51) Int. Cl.

| | |
|---|---|
| ***H01P 1/387*** | (2006.01) |
| ***H01P 1/36*** | (2006.01) |
| ***H01P 1/38*** | (2006.01) |
| ***H01P 5/12*** | (2006.01) |

(52) U.S. Cl.
CPC ..... *H01P 1/36* (2013.01); *H01P 1/38* (2013.01); *H01P 1/387* (2013.01); *H01P 5/12* (2013.01)

(58) Field of Classification Search
CPC ..... H01P 1/36; H01P 1/38; H01P 1/32; H01P 1/383; H01P 1/387
USPC ..... 333/1.1, 24.2
See application file for complete search history.

(56) References Cited

U.S. PATENT DOCUMENTS

2003/0112089 A1* 6/2003 Jun ..... H01P 1/387 333/24.2
2017/0133735 A1* 5/2017 Volobouev ..... H01P 5/028
2017/0365574 A1* 12/2017 Abraham ..... H01L 24/83

FOREIGN PATENT DOCUMENTS

CN 204741059 U * 4/2015

* cited by examiner

*Primary Examiner* — Stephen E. Jones
(74) *Attorney, Agent, or Firm* — Westbridge IP LLC

(57) ABSTRACT

A high-efficiency integrated circulator/isolator includes a hollow base having an opening formed in the top, a coupler, a first resistor, and an SMP signal connector, wherein three notches are formed in the peripheral wall of the base, support bases are respectively arranged at the bottoms of the notches, and a laminated assembly is arranged in the base and includes a central conductor; and the coupler, first resistor, and SMP signal connector are respectively arranged on the support bases, the coupler has an output terminal electrically connected to an input terminal of the central conductor as well as a coupling terminal electrically connected to an external monitoring system, and the central conductor has an output terminal electrically connected to an input terminal of the SMP connector as well as an isolation terminal electrically connected to the first resistor. The circulator/isolator is integrated to a greater degree and is smaller in size.

9 Claims, 2 Drawing Sheets

HIGH-EFFICIENCY INTEGRATED CIRCULATOR/ISOLATOR

TECHNICAL FIELD

The invention relates to the technical field of communication devices, in particular to a high-efficiency integrated circulator/isolator.

BACKGROUND

RF links commonly used in the field of communication at present operate in such a manner that signals from a power amplifier sequentially pass through a coupler, a circulator/isolator, and an SMP connector to reach an antenna to be amplified, monitored, protected, and finally transmitted.

With the development of wireless communication technologies, two major demands are put forward on traditional products: miniaturization and high efficiency. Size reduction of devices is helpful for decreasing the overall size of PCBs to realize the miniaturization of products. However, the space of the PCBs may be wasted due to the fact that the devices need to be connected by means of PCB micro-strip lines, which in turn causes a low utilization rate of the PCBs. Besides, impedance matching between different devices (such as between the coupler and the circulator/isolator, or between the circulator/isolator and the SMP connector) causes poor standing waves and high insertion loss of signals, and consequentially, the efficiency of final products is severely limited.

SUMMARY

The technical issue to be settled by the invention is to provide a high-efficiency integrated circulator/isolator.

The technical solution adopted by the invention to settle the above technical issue is as follows: a high-efficiency integrated circulator/isolator comprises a hollow base having an opening formed in the top, a coupler, a first resistor, and an SMP signal connector, wherein three notches are formed in the peripheral wall of the base, support bases are respectively arranged at the bottoms of the notches, and a laminated assembly is arranged in the base and includes a central conductor; and the coupler, first resistor, and SMP signal connector are respectively arranged on the support bases, the coupler has an output terminal electrically connected to an input terminal of the central conductor as well as a coupling terminal electrically connected to an external monitoring system, and the central conductor has an output terminal electrically connected to an input terminal of the SMP connector as well as an isolation terminal electrically connected to the first resistor.

Furthermore, the high-efficiency integrated circulator/isolator further comprises two feed pin assemblies which penetrate through the support base provided with the coupler, and each feed pin assembly includes a dielectric sleeve installed on the support base provided with the coupler and an insert sleeved with the dielectric sleeve; and one feed pin assembly is electrically connected to an input terminal of the coupler, and the other feed pin assembly is electrically connected to the coupling terminal of the coupler.

Furthermore, a locating block used for locating the first resistor is arranged on the support base provided with the first resistor.

Furthermore, the coupler includes a substrate made from ceramic.

Furthermore, the coupler and the SMP connector are respectively welded to the support bases.

Furthermore, the support bases are integrated with the base.

Furthermore, the laminated assembly includes a first magnet, a uniform magnetic iron sheet, a first locating ring, a second locating ring, an anti-rotation iron sheet, a second magnet, a temperature compensation sheet, and a cover plate which are sequentially stacked from bottom to top, wherein ferrites are respectively arranged in the first locating ring and the second locating ring, and the central conductor is clamped between the first locating ring and the second locating ring.

Furthermore, the first locating ring and the second locating ring are dielectric rings.

Furthermore, the cover plate is in threaded connection with the base.

Furthermore, a threaded part is arranged on an external peripheral wall of the cover plate, internal threads matched with the threaded part are arranged on the base, and a rotation hole used for rotating the cover plate is formed in the cover plate.

The invention has the following effects: the coupler, first resistor, and SMP signal connector are compactly installed on the three support bases on the lower part of the base, so that the space occupied by micro-strip lines between these three devices is reduced, and the PCB size is reduced, and the circulator/isolator is integrated to a greater degree and is smaller in size; and meanwhile, the three devices are relatively independent, thereby having higher flexibility and being in good cooperation, so that the impedance of internal devices of the circulator/isolator is reduced, and the working efficiency of the circulator/isolator is improved.

REFERENCE SIGNS

1, base;
2, support base;
3, central conductor;
31, input terminal of central conductor;
32, output terminal of central conductor;
33, isolation terminal of central conductor;
4, coupler;
41, substrate;
42, input terminal of coupler;
43, output terminal of coupler;
44, coupling terminal of coupler;
5, first resistor;
6, SMP signal connector;
7, dielectric sleeve;
8, insert;
9, locating block;
10, first magnet;
11, uniform magnetic iron sheet;
12, first locating ring;
13, second locating ring;

14, anti-rotation iron sheet;
15, second magnet;
16, temperature compensation sheet;
17, cover plate;
18, rotation hole.

DETAILED DESCRIPTION OF THE EMBODIMENTS

The technical contents, purposes, and effects of the invention are expounded as follows in combination with the embodiments and accompanying drawings.

The key concept of the invention lies in that: the coupler, first resistor, and SMP signal connector are installed compactly, so that the circulator/isolator is smaller in size.

Figure 1:
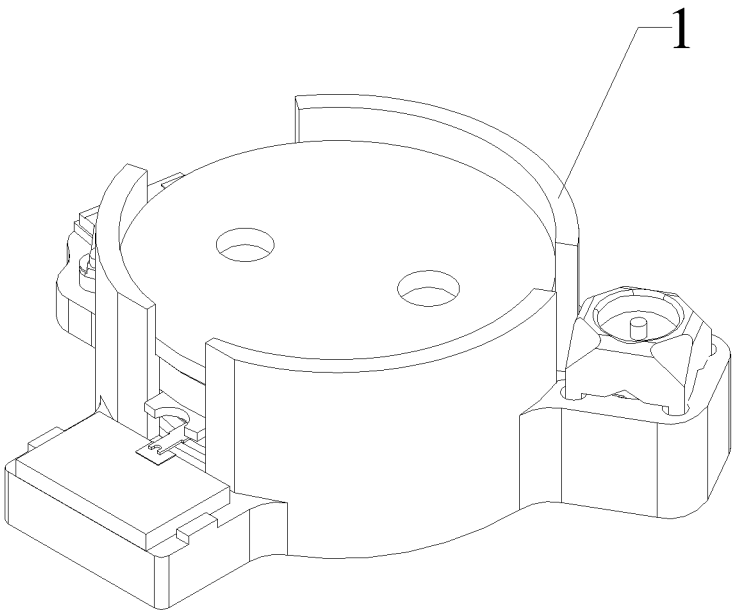
FIG. 1 is an overall structural view of a high-efficiency integrated circulator/isolator in Embodiment 1 of the invention.
Figure 2:
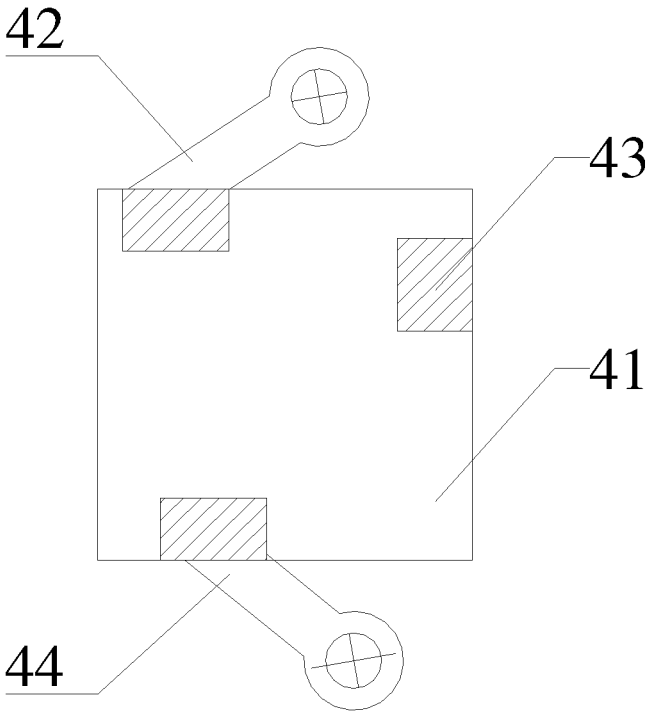
FIG. 2 is a structural view of a coupler in the high-efficiency integrated circulator/isolator in Embodiment 1 of the invention.
Figure 3:
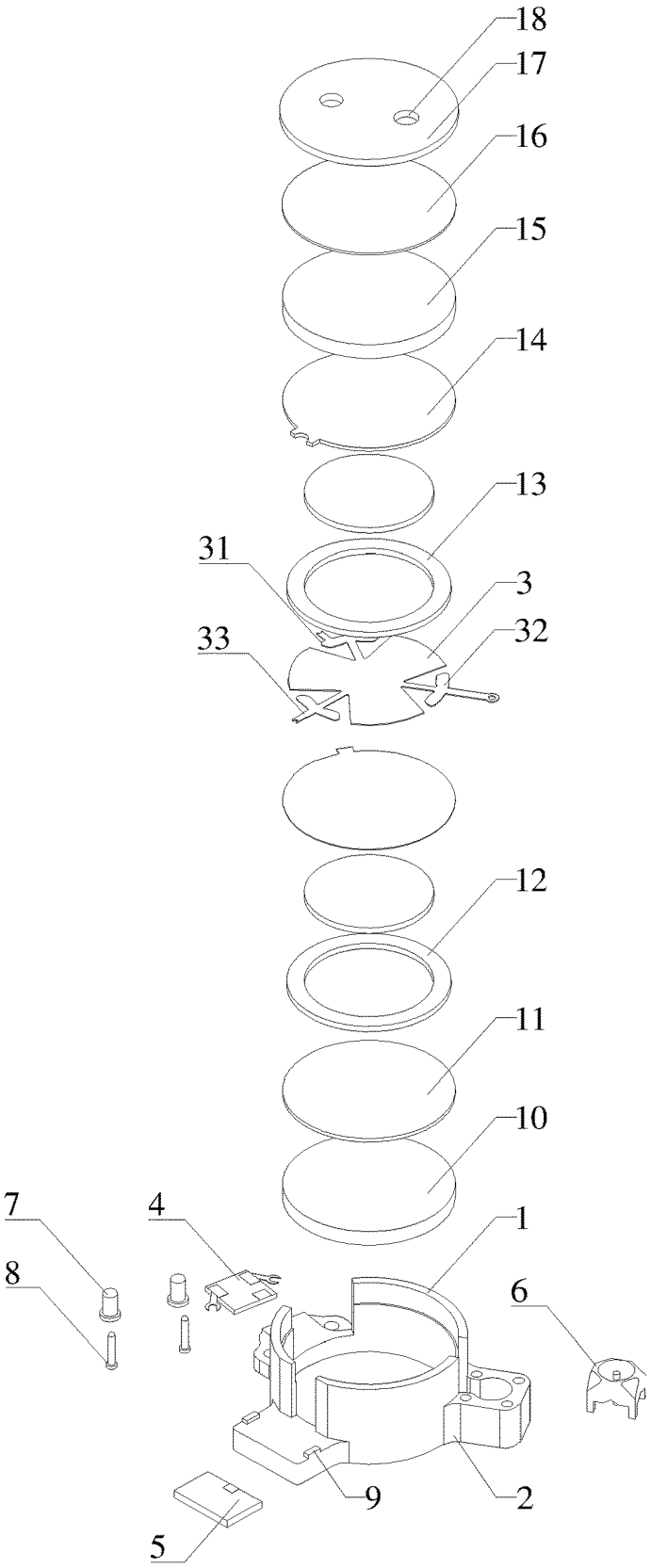
FIG. 3 is an exploded view of the high-efficiency integrated circulator/isolator in Embodiment 1 of the invention.

Referring to FIG. 1 to FIG. 3, a high-efficiency integrated circulator/isolator comprises a hollow base 1 having an opening formed in the top, a coupler 4, a first resistor 5, and an SMP signal connector 6, wherein three notches are formed in the peripheral wall of the base 1, support bases 2 are respectively arranged at the bottoms of the notches, and a laminated assembly is arranged in the base 1 and includes a central conductor 3; and the coupler 4, the first resistor 5, and the SMP signal connector 6 are respectively arranged on the support bases 2, the coupler has an output terminal 43 electrically connected to an input terminal 31 of the central conductor as well as a coupling terminal 44 electrically connected to an external monitoring system, and the central conductor has an output terminal 32 electrically connected to an input terminal of the SMP connector as well as an isolation terminal 33 electrically connected to the first resistor 5.

The operating principle of the invention is briefly described as follows: an external signal is input via an input terminal of the coupler, is processed by the coupler, and is output via the output terminal of the coupler, wherein a coupling signal is output to the system via the coupling terminal of the coupler to be used for system detection; the coupler outputs the signal to the input terminal of the central conductor, and the signal is deflected in the central conductor and is finally output to the SMP connector via the output terminal of the central conductor.

From the above description, the invention has the following effects: the coupler, first resistor, and SMP signal connector are compactly installed on the three support bases on the lower part of the base, so that the space occupied by micro-strip lines between these three devices is reduced, and the PCB size is reduced, and the circulator/isolator is integrated to a greater degree and is smaller in size; and meanwhile, the three devices are relatively independent, thereby having higher flexibility and being in good cooperation, so that the impedance of internal devices of the circulator/isolator is reduced, and the working efficiency of the circulator/isolator is improved.

Furthermore, the high-efficiency integrated circulator/isolator further comprises two feed pin assemblies which penetrate through the support base 2 provided with the coupler 4, and each feed pin assembly includes a dielectric sleeve 7 installed on the support base 2 provided with the coupler 4 and an insert 8 sleeved with the dielectric sleeve 7; and one feed pin assembly is electrically connected to the input terminal of the coupler 4, and the other feed pin assembly is electrically connected to the coupling terminal of the coupler 4.

From the above description, the feed pin assemblies are electrically connected to the coupler, so that the stability is ensured through such connection manner.

Furthermore, a locating block 9 used for locating the first resistor 5 is arranged on the support base 2 provided with the first resistor 5.

From the above description, the locating block abuts against the resistor to fulfill effective fixation.

Furthermore, the coupler 4 includes a substrate made from ceramic.

From the above description, the substrate provides positions for configuring the input terminal, output terminal, and coupling terminal of the coupler, and the ceramic substrate has good insulation and high temperature resistance.

Furthermore, the coupler 4 and the SMP connector are respectively welded to the support bases 2.

From the above description, the coupler is stably connected to the corresponding support base, and the SMP connector is stably connected to the corresponding support base.

Furthermore, the support bases 2 are integrated with the base 1.

From the above description, the support bases and the base which are integrated are convenient to machine and are firmer structurally.

Furthermore, the laminated assembly includes a first magnet 10, a uniform magnetic iron sheet 11, a first locating ring 12, a second locating ring 13, an anti-rotation iron sheet 14, a second magnet 15, a temperature compensation sheet 16, and a cover plate 17 which are sequentially stacked from bottom to top, wherein ferrites are respectively arranged in the first locating ring 12 and the second locating ring 13, and the central conductor 3 is clamped between the first locating ring 12 and the second locating ring 13.

Furthermore, the first locating ring 12 and the second locating ring 13 are dielectric rings.

From the above description, the first locating ring and the second locating ring have a fixing effect, so that device precision is guaranteed; and the dielectric rings have a high dielectric constant, so that the electrical property of the circulator/isolator is improved.

Furthermore, the cover plate 17 is in threaded connection with the base 1.

Furthermore, a threaded part is arranged on the external peripheral wall of the cover plate 17, internal threads matched with the threaded part are arranged on the base 1, and rotation holes 18 used for rotating the cover plate are formed in the cover plate 17.

From the above description, users can assemble and disassemble the cover plate conveniently through the rotation holes.

Embodiment 1

Referring to FIG. 1 to FIG. 3, Embodiment 1 of the invention is as follows: a high-efficiency integrated circulator/isolator comprises a hollow base 1 having an opening formed in the top, a coupler 4, a first resistor 5, and an SMP signal connector 6, wherein three notches are formed in the peripheral wall of the base 1, support bases 2 are respectively arranged at the bottoms of the notches, a laminated assembly is arranged in the base 1 and includes a central conductor 3, and the coupler 4, the first resistor 5, and the SMP signal connector 6 are respectively arranged on the support bases 2; and particularly, the coupler 4 includes a substrate made from ceramic, and a locating block 9 used for locating the first resistor 5 is arranged the support base 2 provided with the first resistor 5. The coupler has an input terminal 42 connected to an external signal source, an output terminal 43 electrically connected to an input terminal 31 of the central conductor, and a coupling terminal 44 electrically connected to an external monitoring system, and the central conductor has an output terminal 32 electrically connected to an input terminal of the SMP connector as well as an isolation terminal 33 electrically connected to the first resistor 5.

In this embodiment, the coupler 4 and the SMP connector are respectively welded to the support bases 2. Optionally, the support bases 2 are integrated with the base 1.

Particularly, the high-efficiency integrated circulator/isolator further comprises two feed pin assemblies which penetrate through the support base 2 provided with the coupler 4, each feed pin assembly includes a dielectric sleeve 7 installed on the support base 2 provided with the coupler 4 and an insert 8 sleeved with the dielectric sleeve 7; and one feed pin assembly is electrically connected to the input terminal of the coupler 4, and the other feed pin assembly is electrically connected to the coupling terminal of the coupler 4.

Particularly, the laminated assembly includes a first magnet 10, a uniform magnetic iron sheet 11, a first locating ring 12, a second locating ring 13, an anti-rotation iron sheet 14, a second magnet 15, a temperature compensation sheet 16, and a cover plate 17 which are sequentially stacked from bottom to top, wherein ferrites are respectively arranged in the first locating ring 12 and the second locating ring 13, and the central conductor 3 is clamped between the first locating ring 12 and the second locating ring 13; and the magnets stimulate a gyromagnetic effect of the ferrites, the uniform magnetic iron sheet 11 makes magnetic lines more uniform, and the temperature compensation sheet 16 guarantees the temperature properties of products. In this embodiment, the first locating ring 12 and the second locating ring 13 are dielectric rings.

Particularly, the cover plate is in threaded connection with the base 1. More particularly, a threaded part is arranged on the external peripheral wall of the cover plate, and internal threads matched with the threaded part are arranged on the base 1. In this embodiment, two rotation holes 18 used for rotating the cover plate are formed in the cover plate 17.

The operating principle of this embodiment is briefly described as follows: an external signal is input via the input terminal of the coupler, is processed by the coupler, and is output via the output terminal of the coupler, wherein a coupling signal is output to the external monitoring system via the coupling terminal of the coupler to be used for the external monitoring system; the signal is output to the input terminal of the central conductor from the coupler, is deflected in the central conductor, and is finally output to the SMP connector via the output terminal of the central conductor.

In conclusion, according to the high-efficiency integrated circulator/isolator of the invention, the coupler, first resistor, and SMP signal connector are compactly installed on the three support bases at the lower part of the base respectively, so that the space occupied by micro-strip lines between these three devices is reduced, the PCB size is reduced, and the circulator/isolator is integrated to a greater degree and is smaller in size; and meanwhile, the three devices are relatively independent, thereby having higher flexibility and being in good cooperation, so that the impedance of internal devices of the circulator/isolator is reduced, and the working efficiency of the circulator/isolator is improved; the feed pin assemblies are electrically connected to the coupler, so that the stability is ensured through such connection manner; the locating block abuts against the resistor to fulfill effective fixation; the substrate provides positions for configuring the input terminal, output terminal, and coupling terminal of the coupler, and the ceramic substrate has good insulation and high temperature resistance; the coupler is stably connected to the corresponding support base, and the SMP connector is stably connected to the corresponding support base; the support bases and the base which are integrated are convenient to machine and are firmer structurally; the first locating ring and the second locating ring have a fixing effect, so that device precision is guaranteed; and the dielectric rings have a high dielectric constant, so that the electrical property of the circulator/isolator is improved; and users can assemble and disassemble the cover plate conveniently through the rotation holes.

The above embodiments are only illustrative ones of the invention, and not intended to limit the patent scope of the invention. All equivalent transformations obtained on the basis of the contents in the specification and the accompanying drawings of the invention or direct or indirect applications to related technical fields fall within the patent protection scope of the invention.

What is claimed is:

1. A high-efficiency integrated circulator/isolator, comprising a hollow base having an opening formed in a top, a coupler, a first resistor, and an SMP signal connector, wherein three notches are formed in a peripheral wall of the base, support bases are respectively arranged at bottoms of the notches, and a laminated assembly is arranged in the base and includes a central conductor; and the coupler, the first resistor, and the SMP signal connector are respectively arranged on the support bases, the coupler has an output terminal electrically connected to an input terminal of the central conductor as well as a coupling terminal electrically connected to an external monitoring system, and the central conductor has an output terminal electrically connected to an input terminal of the SMP connector as well as an isolation terminal electrically connected to the first resistor;

wherein the high-efficiency integrated circulator/isolator further comprises two feed pin assemblies which penetrate through the support base provided with the coupler, and each said feed pin assembly includes a dielectric sleeve installed on the support base provided with the coupler and an insert sleeved with the dielectric sleeve; and one said feed pin assembly is electrically connected to an input terminal of the coupler, and the other feed pin assembly is electrically connected to the coupling terminal of the coupler.

2. The high-efficiency integrated circulator/isolator according to claim 1, wherein a locating block used for locating the first resistor is arranged on the support base provided with the first resistor.

3. The high-efficiency integrated circulator/isolator according to claim 1, wherein the coupler includes a substrate made from ceramic.

4. The high-efficiency integrated circulator/isolator according to claim 1, wherein the coupler and the SMP connector are respectively welded to the support bases.

5. The high-efficiency integrated circulator/isolator according to claim 4, wherein the support bases are integrated with the base.

6. The high-efficiency integrated circulator/isolator according to claim 1, wherein the laminated assembly includes a first magnet, a uniform magnetic iron sheet, a first locating ring, a second locating ring, an anti-rotation iron sheet, a second magnet, a temperature compensation sheet, and a cover plate which are sequentially stacked from bottom to top, wherein ferrites are respectively arranged in the first locating ring and the second locating ring, and the central conductor is clamped between the first locating ring and the second locating ring.

7. The high-efficiency integrated circulator/isolator according to claim 6, wherein the first locating ring and the second locating ring are dielectric rings.

8. The high-efficiency integrated circulator/isolator according to claim 6, wherein the cover plate is in threaded connection with the base.

9. The high-efficiency integrated circulator/isolator according to claim 8, wherein a threaded part is arranged on an external peripheral wall of the cover plate, internal threads matched with the threaded part are arranged on the base, and a rotation hole used for rotating the cover plate is formed in the cover plate.

* * * * *